US010967291B1

(12) United States Patent
Padilla

(10) Patent No.: US 10,967,291 B1
(45) Date of Patent: Apr. 6, 2021

(54) PIÑATA APPARATUS AND METHODS OF ASSEMBLING THE SAME

(71) Applicant: Miriam Veronica Padilla, San Diego, CA (US)

(72) Inventor: Miriam Veronica Padilla, San Diego, CA (US)

(73) Assignee: Miriam Veronica Padilla, San Diego, CA (US)

( * ) Notice: Subject to any disclaimer, the term of this patent is extended or adjusted under 35 U.S.C. 154(b) by 0 days.

(21) Appl. No.: 16/701,874

(22) Filed: Dec. 3, 2019

(51) Int. Cl.

| | |
|---|---|
| ***A63H 37/00*** | (2006.01) |
| ***B65B 7/28*** | (2006.01) |
| ***B65B 5/04*** | (2006.01) |
| ***B65D 25/04*** | (2006.01) |
| ***B65D 5/42*** | (2006.01) |

(52) U.S. Cl.
CPC ..... *A63H 37/00* (2013.01); *B65B 5/04* (2013.01); *B65B 7/28* (2013.01); *B65D 5/4204* (2013.01); *B65D 25/04* (2013.01)

(58) Field of Classification Search
CPC ..... A63H 37/00; B65D 5/48; B65D 5/4204; B65D 25/04
See application file for complete search history.

(56) References Cited

U.S. PATENT DOCUMENTS 312,421 A * 2/1885 Bauer
1,153,298 A * 9/1915 Emkins ..... B65D 85/324 206/521.1
1,554,077 A * 9/1925 Fay ..... A21B 3/132 220/552
1,630,140 A * 5/1927 Sibbald ..... A21B 3/132 220/552
1,922,208 A * 8/1933 Knorpp ..... B65D 75/52 229/162.1
3,715,280 A * 2/1973 Farmer, III ..... C12M 23/34 435/34
5,096,056 A * 3/1992 Garcia ..... A45C 13/02 206/455

(Continued)

OTHER PUBLICATIONS

"Christmas Gift Prize Punch Game" available from www.orientaltrading.com (Year: 2018).*

(Continued)

*Primary Examiner* — John A Ricci
(74) *Attorney, Agent, or Firm* — Garson & Gutierrez, PC

(57) ABSTRACT

Piñata apparatus and methods of assembling the same. In one embodiment, the piñata apparatus includes a lid container having a plurality of apertures disposed therein and a back container which is configured to house a plurality of divider elements, the plurality of divider elements configured to create a plurality of cavities, respective ones of the plurality of cavities being associated with respective ones of the plurality of apertures. The plurality of cavities is configured to house a plurality of chattels and a user of the piñata apparatus is able to access respective ones of the plurality of chattels by reaching through one of the plurality of apertures. Embodiments are also disclosed in which multiple piñata apparatus are attached to one another. Individual ones of the multiple piñata apparatus may contain separate classifications of chattels.

17 Claims, 6 Drawing Sheets

(56) References Cited

U.S. PATENT DOCUMENTS

2005/0056688 A1* 3/2005 Hsi-Ching ..... B65D 5/4204
229/120.17

OTHER PUBLICATIONS

"Prize Punch Box Party Game" available from www.amazon.com (Year: 2019).*
"Personalized Prize Punch Game" available from www.stumpsparty.com (Year: 2020).*

* cited by examiner

PIÑATA APPARATUS AND METHODS OF ASSEMBLING THE SAME

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE DISCLOSURE

1. Technological Field

The present disclosure relates generally to a piñata apparatus, and more particularly in one exemplary aspect to a piñata apparatus that addresses various deficiencies present in the prior art.

2. Field of the Disclosure

Piñatas are containers that are made from any number of suitable materials including papier-mâché, cloth, pottery as well as other materials. Piñatas are often decorated and filled with candy, toys, or both, and then broken apart using, for example, a stick or bat as part of a ceremony or celebration, such as a child's birthday party. The use of piñatas is ubiquitous, particularly throughout North America, including the United States and Mexico. Piñatas are also often made into a variety of shapes and sizes and make take the form of, for example, various abstract designs as well as characters that may be based on, for example, movies or television shows.

More recently, the use of piñatas has been banned in public parks as well as other public (or private) spaces. The ostensible purpose behind these bans is so that the waste generated during the destruction of the piñata does not result in litter and other environmental hazards that can be costly and difficult to clean up. This resulting litter may also be a visual nuisance and even may be thought to have adverse effects on wildlife, etc. Additionally, piñatas may be banned in environments where it is undesirable to suspend a piñata or for individuals to swing a bat or other clubbing-device to break the piñata. Moreover, some participants in the breaking of a piñata may not be capable of delivering a strike to the piñata making participation by, for example, young children, the elderly, or physically disabled persons difficult or impossible. Accordingly, solutions are needed which address these, and other, deficiencies present with existing piñatas.

SUMMARY

The present disclosure satisfies the foregoing needs by providing, inter alia, piñatas that address, inter alia, perceived concerns associated with their use as well as enabling participation by those that, due to physical limitations, are unable to participate in the ceremony surrounding traditional piñata designs.

In one aspect, a piñata apparatus is disclosed. In one embodiment, the piñata apparatus includes a lid container having a plurality of apertures disposed therein and a back container which is configured to house a plurality of divider elements, the plurality of divider elements configured to create a plurality of cavities, respective ones of the plurality of cavities being associated with respective ones of the plurality of apertures.

In one variant, the plurality of cavities is configured to house a plurality of chattels, a user of the piñata apparatus is able to access respective ones of the plurality of chattels by reaching through one of the plurality of apertures.

In another variant, the piñata apparatus includes a plurality of aperture covering elements, respective ones of the plurality of aperture covering elements being configured to cover respective ones of the plurality of apertures.

In yet another variant, a backside of the lid container further includes a thin covering, the thin covering configured to act as a barrier between the outside of the piñata apparatus and the plurality of cavities disposed within the piñata apparatus.

In yet another variant, the plurality of divider elements includes a plurality of column divider elements and a plurality of row divider elements, each of the plurality of column divider elements and the plurality of row divider elements includes slots, the slots enabling the assembly of the plurality of column divider elements to the plurality of row divider elements in order to generate the plurality of cavities.

In yet another variant, the piñata apparatus further includes a support structure having a plurality of apertures disposed therein, at least some of the plurality of divider elements also having a plurality of apertures disposed therein, the plurality of apertures associated with at least some of the plurality of divider elements and the plurality of apertures associated with the support structure are configured to be joined together via use of a fastening mechanism so as to prevent chattels located within one cavity of the plurality of cavities from entering another cavity of the plurality of cavities.

In yet another variant, the piñata apparatus includes a plurality of decorative elements that are configured to be secured to the piñata apparatus.

In yet another variant, one of the plurality of decorative elements includes a cardboard cutout having a stick attached thereto, the stick being configured to be received within an aperture located on one or both of the lid container and/or the back container.

In yet another variant, another one of the plurality of decorative elements includes tissue and/or crepe paper.

In yet another variant, the lid container and the back container is selected from the group consisting of: cardboard, plastic, metal and wood.

In yet another variant, additional piñata apparatus are joined together.

In another aspect, a method for assembling a piñata apparatus is disclosed. In one embodiment, the method includes: removing the piñata apparatus from packaging associated with the piñata apparatus; assembling divider elements by placing a first slot located on a first divider element into a second slot located on a second divider element; placing the assembled divider elements into a back container; inserting chattels into cavities formed by the assembled divider elements; and assembling a lid container onto the back container.

In one variant, the assembling of the divider elements includes securing at least a portion of the divider elements to a support structure.

In another variant, the securing of the at least the portion of the divider elements to the support structure includes using twist ties.

In yet another variant, the method further includes decorating the piñata apparatus using tissue and/or crepe paper and securing the tissue and/or crepe paper to the outside of the piñata apparatus.

In yet another variant, the decorating includes inserting a cardboard cutout into an aperture located on one or both of the lid container and/or the back container.

In yet another variant, the method further includes attaching a plurality of aperture covering elements over respective apertures located on the lid container.

In yet another variant, the method further includes attaching a thin covering to an inside surface of the lid container.

In yet another variant, the lid container and the back container are stored in the packaging associated with the piñata apparatus in a two-dimensional form and the method further includes assembling the lid container and the back container into a three-dimensional form.

In yet another variant, the divider elements are stored in the packaging associated with the piñata apparatus in a two-dimensional form and the assembling of the divider elements includes assembling the divider elements into a three-dimensional form.

Other features and advantages of the present disclosure will immediately be recognized by persons of ordinary skill in the art with reference to the attached drawings and detailed description of exemplary implementations as given below.

BRIEF DESCRIPTION OF THE DRAWINGS

The features, objectives, and advantages of the present disclosure will become more apparent from the detailed description set forth below when taken in conjunction with the drawings, wherein.

All Figures disclosed herein are © Copyright 2019 Miriam Veronica Padilla. All rights reserved.

DETAILED DESCRIPTION

Exemplary Embodiments

Detailed descriptions of the various embodiments and variants of the apparatus and methods of the present disclosure are now provided. It is noted that wherever practicable similar or like reference numbers may be used in the figures and may indicate similar or like functionality. The figures depict embodiments of the disclosed system (or methods) for purposes of illustration only. One skilled in the art will readily recognize from the following description that alternative embodiments of the structures and methods illustrated herein may be employed without necessarily departing from the principles described herein.

Exemplary Piñata Apparatus—

Referring now to FIGS. 1A-1D, one exemplary piñata apparatus 100 (e.g., a so-called "Fantasy Piñata") is shown and described in detail. The piñata apparatus 100 of FIGS. 1A-1D is rectangular in shape and dimension, although it would be readily apparent to one of ordinary skill given the contents of the present disclosure that such a shape is not necessarily a prerequisite in order to practice the concepts of the present disclosure. For example, the piñata apparatus 100 may take on more traditional forms and may include a variety of sizes and dimensions that may allow the piñata apparatus 100 to represent both symmetrical and non-symmetrical outlines and three-dimensional shapes including, for example, those of entertainment characters and symbols. Accordingly, while the size and shape of the piñata apparatus 100 may take the form of a near limitless number of shapes/sizes, in the illustrated embodiment of FIGS. 1A-1D, the piñata apparatus 100 may have a height dimension of approximately sixty-eight (68) cm, a width of approximately fifty (50) cm, and a depth of approximately ten (10) cm. The piñata apparatus 100 may be constructed from any number of suitable materials including cardboard, plastic, wood, and even metal materials. The piñata apparatus 100 may be constructed in a fashion which enables it to be re-usable. For example, design kits can be sold such that the underlying piñata apparatus 100 may be re-decorated after use. However, in some implementations, the piñata apparatus 100 may be intended for a single use and may simply be discarded afterwards.

Figure 1A:
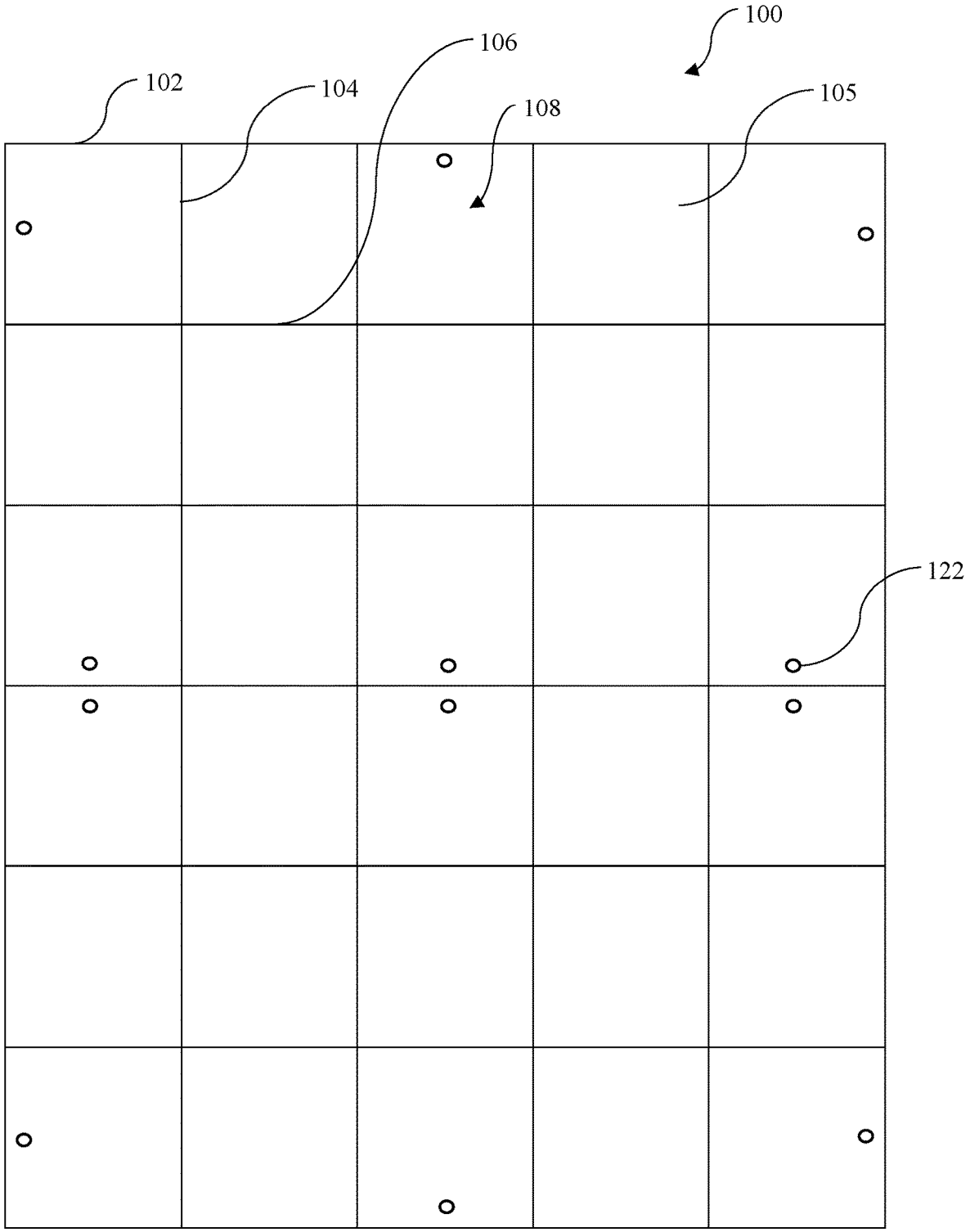
FIG. 1A is a front plan view of the back container with the divider elements installed therein for an exemplary piñata apparatus, in accordance with the principles of the present disclosure.

FIG. 1A illustrates a front plan view of an exemplary back container 102 for the piñata apparatus 100. The back container 102 may consist of a number of cavities 108 that are each configured to hold a variety of chattels for the piñata apparatus 100. These chattels may consist of candies, toys, or other gifts to be dispensed that may, for example, be dependent upon the type of celebration or event for which the piñata apparatus 100 is intended. For example, in one implementation, the cavities 108 may be filled with candies for a child's birthday party. In another implementation, the cavities 108 may be filled with age-appropriate toys to be dispensed as gifts for the participants. For example, the cavities 108 may be filled with single-serving alcoholic beverages intended for consumption by age-appropriate guests. In yet another implementation, the piñata apparatus 100 may include multiple different treats that are segmented (see e.g., the piñata apparatus 200 of FIG. 2) based on a classification of the participants. For example, one segment may contain age-appropriate gifts for young children, another segment may contain age-appropriate gifts for teenagers, while yet another segment may contain age-appropriate gifts for young adults. These and other variants would be readily apparent to one of ordinary skill given the contents of the present disclosure.

The back container 102 cavities 108 may be created through the inclusion of various divider elements 104, 106. In the illustrated embodiment, the divider elements consist of column divider elements 104 and row divider elements 106. In particular, in the illustrated embodiment, the back container 102 includes four (4) column divider elements 104 and five (5) row divider elements 106, although it would be readily apparent that the number of row 106 and column 104 divider elements may be readily varied dependent upon, for example, the overall dimensions and shape of the piñata apparatus 100. For example, in one exemplary embodiment, the number of column divider elements 104 may be six (6), while the number of row divider elements 106 may be seven (7). The length of the column divider elements 104 may be sixty-three and a half (63.5) cm with a depth of nine and a half (9.5) cm. The length of the row divider elements 106 may be forty-eight (48) cm with a depth of nine and a half (9.5) cm. The cavities 108 need not necessarily be square or rectangular in shape as illustrated. For example, these cavities 108 may take the form of other polygon shapes (e.g., triangle, pentagon, hexagon, octagon, etc.) as well as non-polygon shapes such as circles or ovals. In some implementations, the divider elements 104, 106 may be attached to a support structure 105. The support structure 105 may consist of one of the aforementioned cardboard, plastic, wood, and even metal materials. The support structure 105 may include a plurality of apertures 122 that are configured to be connected to respective apertures 122 located on the divider elements using, for example, string, twist ties, zip ties and/or other suitable means for securing the divider elements 104, 106 to the support structure 105 and/or the back container 102. These and other variants would be readily apparent to one of ordinary skill given the contents of the present disclosure.

Figure 1B:
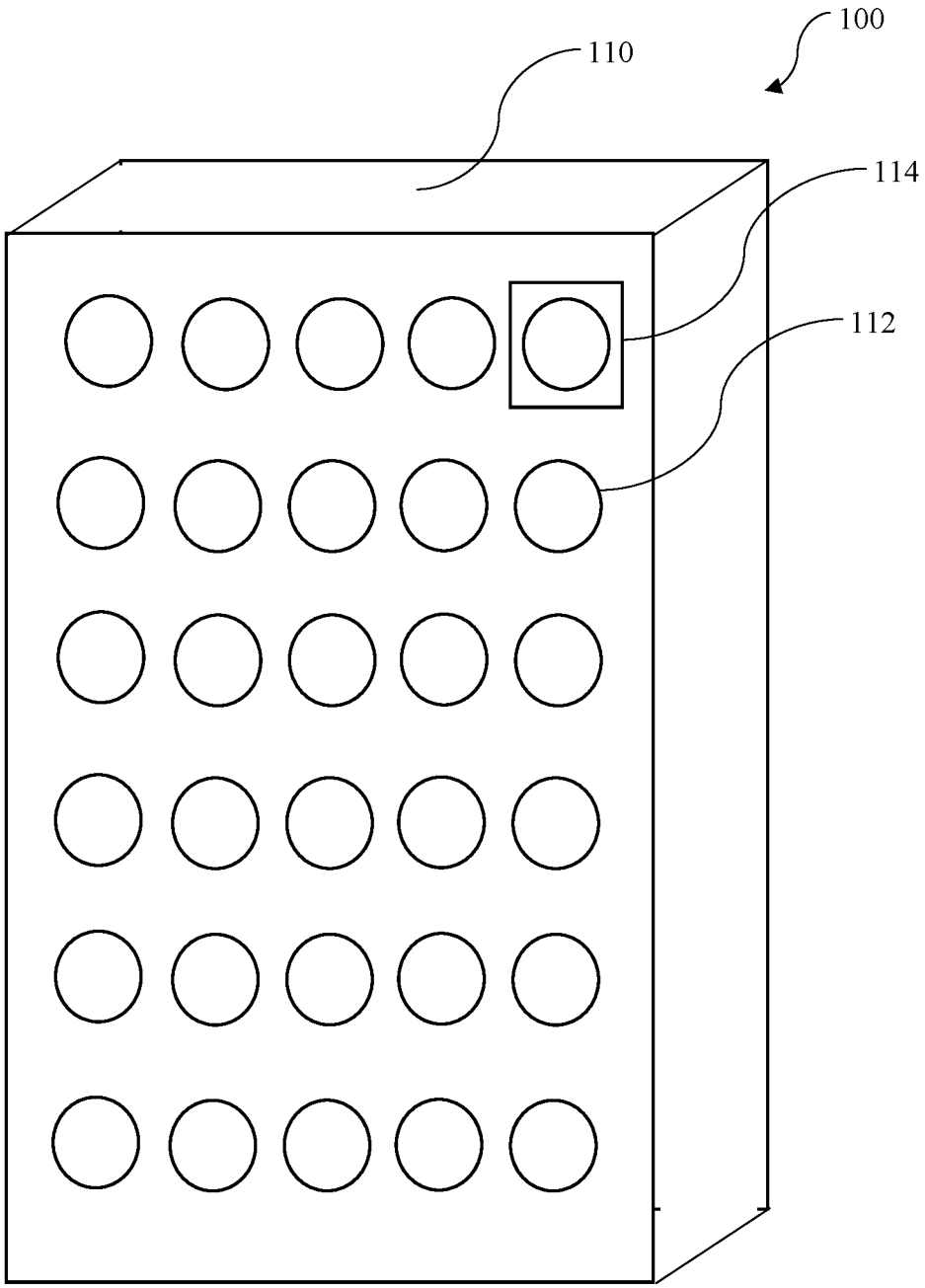
FIG. 1B is a perspective view of an exemplary piñata apparatus, in accordance with the principles of the present disclosure.

Referring now to FIG. 1B, a perspective view of an exemplary piñata apparatus 100 is shown and described in detail. The front container 110 may be received over (or under) the back container 102. Fastening mechanisms may be applied to one or both of the front container 110 and the back container 102. These fastening mechanisms may consist of, for example, hook and loop fasteners (e.g., Velcro®), double-sided tape, buttons, twist ties and/or other suitable types of fastening mechanisms. In some implementations, the fastening mechanisms chosen may allow for the piñata apparatus 100 to be re-usable. The front container 110 may include a number of apertures 112. Each of these apertures 112 may be associated with a given cavity 108 located within the back container 102. While the apertures 112 are illustrated in FIG. 1B as consisting of circular holes, it would be readily apparent to one of ordinary skill given the contents of the present disclosure that other shapes may be readily substituted in alternative variants. For example, the apertures 112 may consist of polygon-shaped apertures 112 (whether convex or concave-type polygons).

In some variants, the apertures 112 may be replaced with perforations such that the apertures 112 are not present until after the perforations have been "punched out". In some variants, the apertures 112 may be covered up with an aperture covering element 114. The aperture covering element 114 may consist of a thin film tape or paper that is secured to the outer surface of the front container 110. This thin film tape or paper (or aperture covering element 114) may enable the cavities 108 to be accessed by a user punching through this thin film tape in order to access the chattels contained within the respective cavity 108. Advantageously, the use of the aperture covering elements 114 enables the exemplary piñata apparatus 100 to be reusable. In other words, once the contents of the cavities 108 have been removed, the cavities may be re-filled and new aperture covering elements 114 may be re-installed over the apertures.

The exemplary piñata apparatus 100 may be decorated in a manner which is consistent with prior piñata designs. For example, tissue paper and/or crepe paper may be applied to the exterior surface of the exemplary piñata apparatus 100. The tissue paper and/or crepe paper may be folded and cut into strips. Slits may be cut into these folded strips in order to create a garland. The tissue paper and/or crepe paper may include a variety of colors and sizes in order to create any number of decorative piñata apparatus forms. A variety of centerpieces or other adornments may also be added to the piñata apparatus 100 as well. For example, various tissue paper and cardstock centerpieces may be added that can be attached to a stick, such as a popsicle stick, in order to create a variety of differing decorative elements for the piñata apparatus 100. One or more aperture(s) may be present within the piñata apparatus 100 in order to receive the aforementioned stick. Moreover, as exemplary variants of the piñata apparatus are re-usable, one centerpiece may be substituted for another centerpiece (or centerpieces) in order to customize the piñata apparatus for the desired event or occasion. The centerpiece (or centerpieces) may consist of popular children's characters (e.g., Snow White, Iron Man, Superman, etc.) or literally any other type of character or design (e.g., party favors, fruits, liquor, wine and/or beer bottles, etc.) that is desired by the consumer. These and other variants would be readily apparent to one of ordinary skill given the contents of the present disclosure.

Figure 1C:
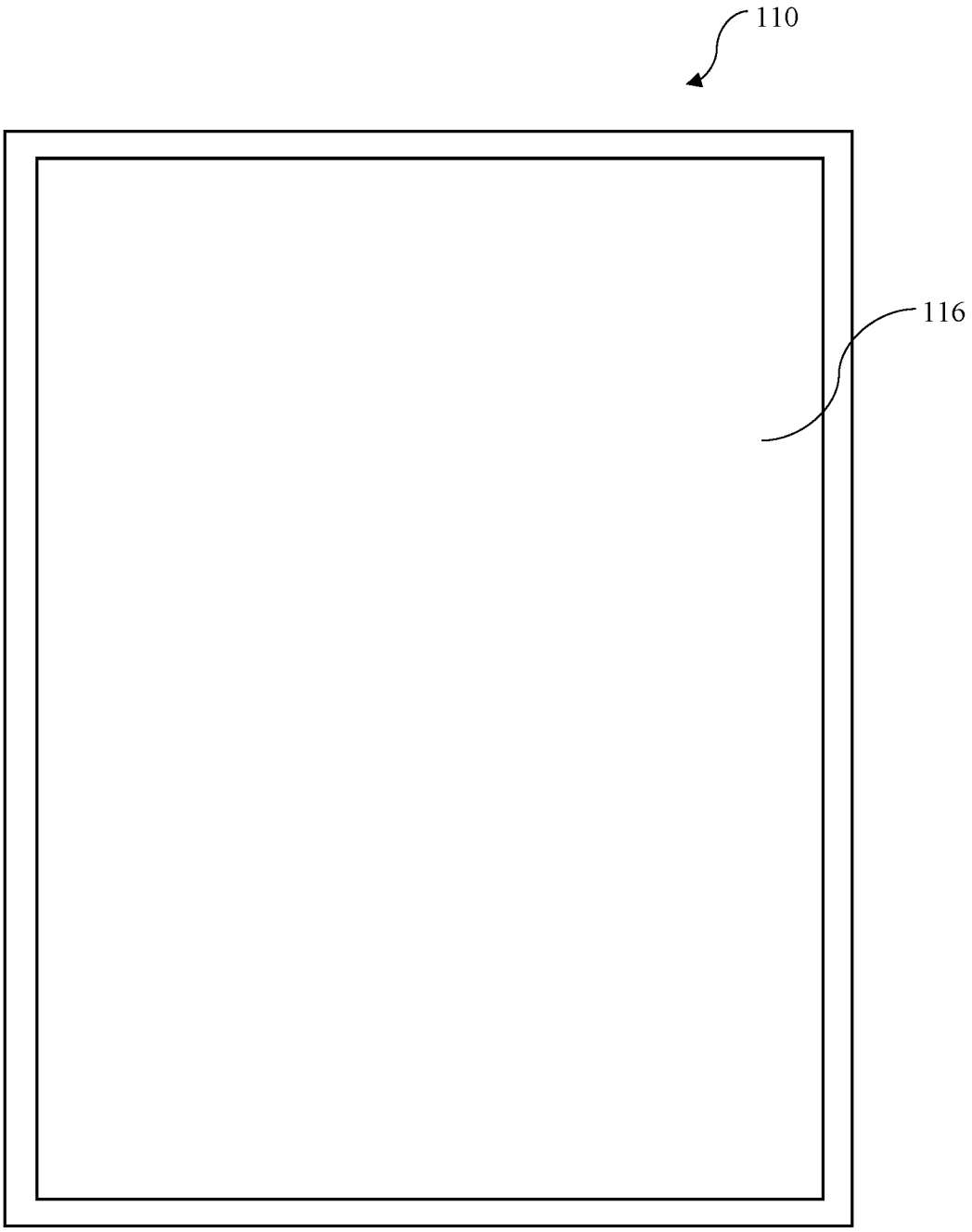
FIG. 1C is a back-plan view of the lid container for an exemplary piñata apparatus, in accordance with the principles of the present disclosure.

Referring now to FIG. 1C, an exemplary implementation of a front container 110 is shown and described in detail. In particular, the backside of the front container 110 is shown. Within the front container 110, a thin covering 116 may be applied that covers up the apertures 112 seen in FIG. 1B. The thin covering 116 may consist of, for example, tissue paper, which enables a user to pierce through the aperture 112 (and the thin covering 116) in order to access the chattel(s) contained within the cavities 108. The thin covering 116 may be used in addition to (or alternatively from) the aperture covering element 114 shown in FIG. 1B. The thin covering 116 may also form a decorative element for the piñata apparatus 100. For example, the thin covering 116 may possess a color that is consistent with other decorative elements that are present on the piñata apparatus 100. As but one non-limiting example, the thin covering 116 may be pink so as to be consistent thematically with a princess piñata apparatus 100, or may be blue so as to be consistent thematically with an ocean-themed piñata apparatus 100, etc. These and other variants would be readily apparent to one of ordinary skill given the contents of the present disclosure.

Figure 1D:
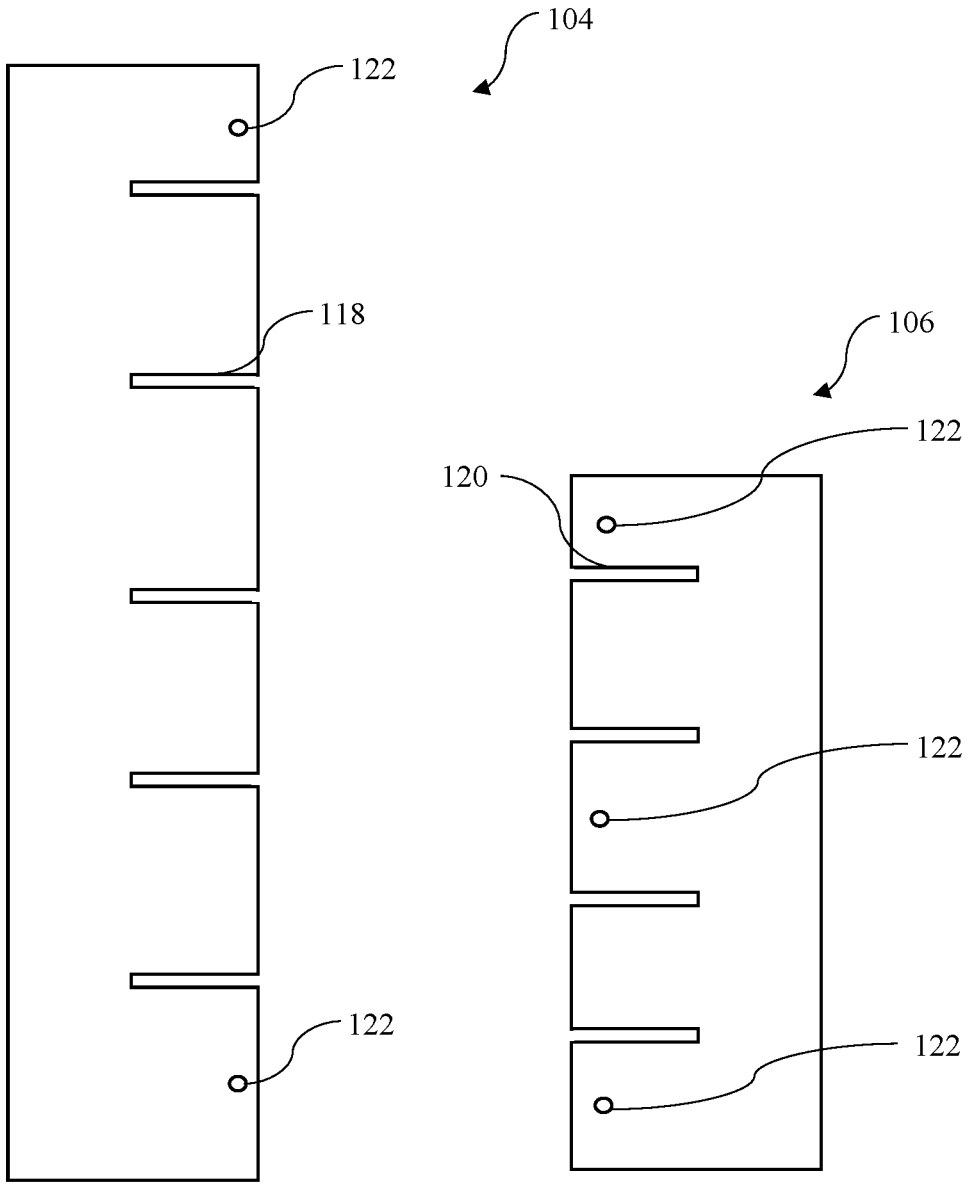
FIG. 1D is a side view of exemplary divider elements for use with an exemplary piñata apparatus, in accordance with the principles of the present disclosure.

FIG. 1D illustrates exemplary features for some implementations of the divider elements 104, 106. The column divider elements 104 may consist of a series of slots 118, while the row divider elements 106 similarly contain a series of slots 120. These series of slots 118, 120 enable the column divider elements 104 to be assembled to the row divider elements 106 such as, for example, as shown in FIG. 1A. The divider elements 104, 106 may also optionally include a series of apertures 122. These apertures 122 may be utilized in conjunction with similar apertures located on the back container 102 and/or the support structure 105 in order to secure the divider elements 104, 106 to the back container 102 and/or the support structure 105 (and/or other ones of the divider elements 104, 106) so as to, for example, prevent the contents of one cavity 108 from entering another cavity 108. The apertures 122 may be utilized in conjunction with string, twist ties, zip ties and/or other suitable means for securing the divider elements 104, 106 to the support structure 105 and/or the back container 102 and/or other ones of the divider elements 104, 106. In instances in which there is a low chance of items migrating from one cavity 108 to another cavity 108, or where the acquirer of the piñata apparatus 100 is unconcerned about items migrating from one cavity 108 to another cavity, these apertures 122 may be obviated (or not used) from the divider elements 104, 106 and/or the back container 102. The positioning and/or number of apertures 122 may be varied in some implementations for some (or all) of the divider elements 104, 106.

Figure 2:
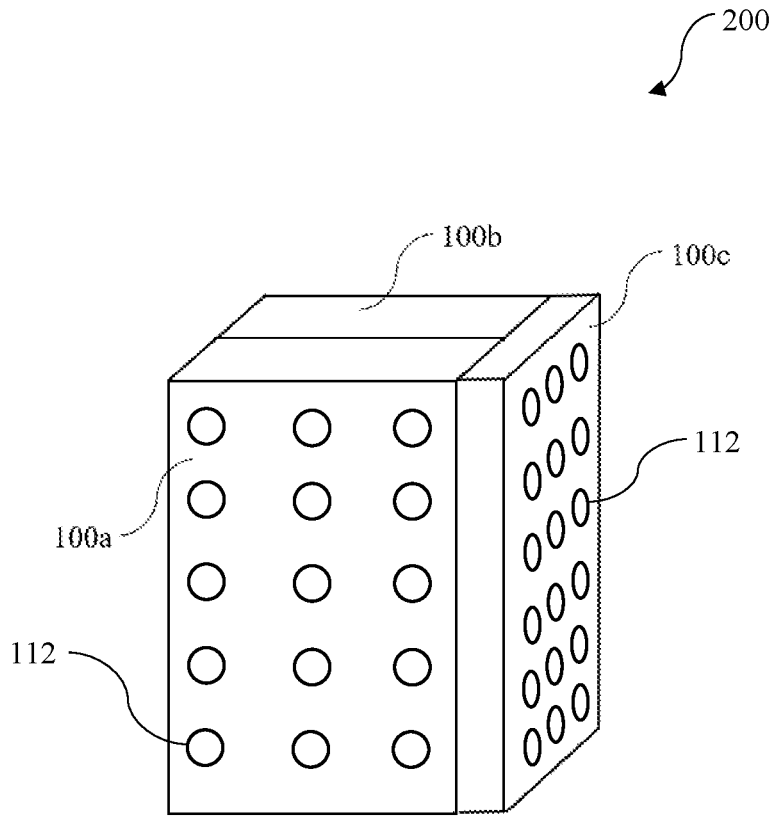
FIG. 2 is a perspective view of an exemplary piñata apparatus assembly, in accordance with the principles of the present disclosure.

Referring now to FIG. 2, one exemplary implementation of a piñata assembly 200 is shown and described in detail. Specifically, as illustrated, the piñata assembly 200 includes three (3) piñata apparatuses 100, namely a front piñata apparatus 100*a*, a back-piñata apparatus 100*b*, and a side piñata apparatus 100*c*. While a specific configuration is shown in FIG. 2, it would be readily apparent that the terms "front", "back", and "side" are merely used to describe the assembly 200 from one perspective and not necessarily used to connote an absolute frame of reference for the positioning of the various piñata apparatuses 100. Moreover, additional piñata apparatus(es) 100 may be included in other variants including, for example, positioning a piñata apparatus 100 on the other "side", on the "top", and/or on the "bottom". These and other variants for the piñata assembly 200 would be readily understood given the contents of the present disclosure. Referring back to the piñata assembly 200 illustrated in FIG. 2, one piñata apparatus 100*a* may include chattels for one class of users, a second piñata apparatus 100*b* may include chattels for a second class of users, while the third piñata apparatus 100*c* may include chattels for a third class of users. By way of one non-limiting example, the first class of users might be for boys, the second class of users might be for girls, while the third class of users might be for adults. In this fashion, one piñata assembly 200 may be desirable for a plurality of different users of the piñata assembly 200. These and other variants would be readily apparent to one of ordinary skill given the contents of the present disclosure.

Exemplary Assembly Methodology—

Figure 3:
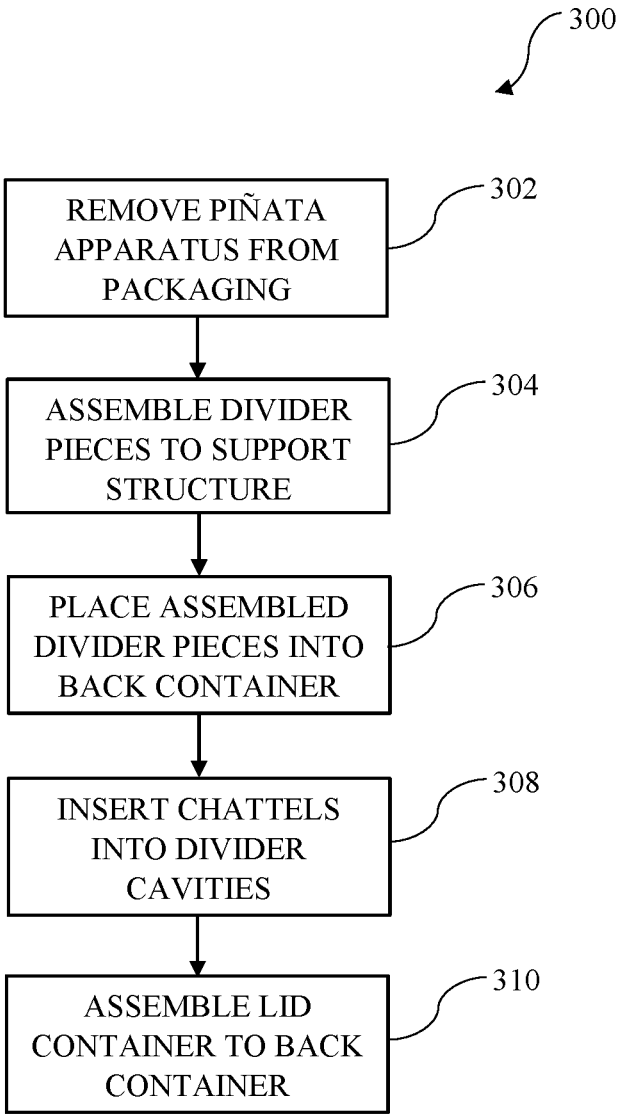
FIG. 3 is a logical flow diagram of an exemplary methodology for assembling an exemplary piñata apparatus, in accordance with the principles of the present disclosure.

Referring now to FIG. 3, one exemplary methodology 300 for the assembling of a piñata apparatus 100 is shown and described in detail. At step 302, the unassembled piñata apparatus 100 is removed from its packaging. Advantageously, the unassembled piñata apparatus 100 is packaged in a relatively flat state to minimize its footprint during transport and storage. The unassembled piñata apparatus 100 may consist of one or more of an unassembled box; paper board (for e.g., the divider elements 104, 106); tissue paper (for e.g., decoration(s), the thin covering 116, etc.); one or more popsicle sticks; decorative stickers; twist ties or other suitable means (for e.g., securing the divider elements 104, 106); and/or instructions for its assembly. Other items that may be included, or suggested, for the assembly process include one or more of scissors, paste and/or glue, tape, hook-and-loop fasteners, a hot glue gun, etc.

At step 304, the divider elements 104, 106 are assembled. In some implementations, the column divider elements 104 may consist of a series of slots 118, while the row divider elements 106 may similarly contain a series of slots 120. These series of slots 118, 120 enable respective column divider elements 104 to be assembled to respective row divider elements 106 such as, for example, as shown in FIG. 1A. In another implementation, the divider elements 104, 106 may arrive in the packaging pre-assembled. In such an implementation, the divider elements 104, 106 may be shipped in a flat state and then may be transformed into its final form by pulling a portion of the divider elements 104, 106 away from other portions of the divider elements 104, 106. In some implementations, the divider elements 104, 106 may be assembled to a support structure 105 through the use of, for example, string, twist ties, zip ties and/or other suitable means for securing the divider elements 104, 106 to the support structure 105 and/or the back container 102 and/or other ones of the divider elements 104, 106.

At step 306, the assembled divider elements 104, 106 are placed into the back container 102. In some implementations, apertures 122 present within the assembled divider elements are utilized to attach the assembled divider elements 104, 106 to the back container 102. In yet other implementations, the assembled divider elements 104, 106 are glued to the back container 102 directly, thereby effectively preventing chattels present in on cavity 108 from entering another cavity 108 without necessarily necessitating the presence of the support structure 105.

At step 308, chattels are inserted into the divider cavities 108 and at step 310, the lid container 110 is assembled onto the back container 102. In some implementations, a fastening mechanism is attached to the lid container 110 and/or the back container 102 prior to the lid container 110 being attached to the back container 102. In some implementations, decorative items are included with the packaging and the acquirer of the piñata apparatus 100 may use the included decorative items in order to customize the appearance of the piñata apparatus 100. The piñata apparatus 100 may then be used in a variety of settings, including outdoors as well as indoors. The use of the piñata apparatus 100 indoors is made easier as the resultant use of the piñata apparatus 100 is not destructive and messy. Because of these advantages, the piñata apparatus 100 can be used in bad climate conditions (e.g., during snowstorms, heavy downpours, etc.) which may typically be present around the holidays including Thanksgiving, Christmas and/or New Years.

It will be recognized that while certain aspects of the present disclosure are described in terms of specific design examples, these descriptions are only illustrative of the broader methods of the disclosure and may be modified as required by the particular design. Certain steps may be rendered unnecessary or optional under certain circumstances. Additionally, certain steps or functionality may be added to the disclosed embodiments, or the order of performance of two or more steps permuted. All such variations are considered to be encompassed within the present disclosure described and claimed herein.

While the above detailed description has shown, described, and pointed out novel features of the present disclosure as applied to various embodiments, it will be understood that various omissions, substitutions, and changes in the form and details of the device or process illustrated may be made by those skilled in the art without departing from the principles of the present disclosure. The foregoing description is of the best mode presently contemplated of carrying out the present disclosure. This description is in no way meant to be limiting, but rather should be taken as illustrative of the general principles of the present disclosure. The scope of the present disclosure should be determined with reference to the claims.

What is claimed is:

1. A piñata apparatus, comprising:

a lid container comprising a plurality of apertures disposed therein;

a back container which is configured to house a plurality of divider elements, the plurality of divider elements configured to create a plurality of cavities, respective ones of the plurality of cavities being associated with respective ones of the plurality of apertures, the plurality of divider elements comprising a plurality of column divider elements and a plurality of row divider elements, each of the plurality of column divider elements and the plurality of row divider elements being comprised of slots, the slots enabling the assembly of the plurality of column divider elements to the plurality of row divider elements in order to generate the plurality of cavities; and a support structure having a plurality of apertures disposed therein, wherein at least some of the plurality of divider elements also comprise a plurality of apertures disposed therein, the plurality of apertures associated with at least some of the plurality of divider elements and the plurality of apertures associated with the support structure are configured to be joined together via use of a fastening mechanism so as to prevent chattels located within one cavity of the plurality of cavities from entering another cavity of the plurality of cavities;

wherein the plurality of cavities is configured to house the chattels, a user of the piñata apparatus is able to access respective ones of the chattels by reaching through one of the plurality of apertures.

2. The piñata apparatus of claim 1, further comprising a plurality of aperture covering elements, respective ones of the plurality of aperture covering elements being configured to cover respective ones of the plurality of apertures.

3. The piñata apparatus of claim 1, wherein a backside of the lid container further comprises a thin covering, the thin covering configured to act as a barrier between the outside of the piñata apparatus and the plurality of cavities disposed within the piñata apparatus.

4. The piñata apparatus of claim 1, further comprising a plurality of decorative elements that are configured to be secured to the piñata apparatus.

5. The piñata apparatus of claim 4, wherein one of the plurality of decorative elements comprises a cardboard cutout having a stick attached thereto, the stick being configured to be received within an aperture located on one or both of the lid container and/or the back container.

6. The piñata apparatus of claim 5, wherein another one of the plurality of decorative elements comprises tissue and/or crepe paper.

7. The piñata apparatus of claim 1, wherein the lid container and the back container is selected from the group consisting of: cardboard, plastic, metal and wood.

8. The piñata apparatus of claim 7, further comprising a plurality of aperture covering elements, respective ones of the plurality of aperture covering elements being configured to cover respective ones of the plurality of apertures.

9. The piñata apparatus of claim 7, wherein a backside of the lid container further comprises a thin covering, the thin covering configured to act as a barrier between the outside of the piñata apparatus and the plurality of cavities disposed within the piñata apparatus.

10. A method for assembling a piñata apparatus, the method comprising:

removing the piñata apparatus from packaging associated with the piñata apparatus;

assembling divider elements by placing a first slot located on a first divider element into a second slot located on a second divider element;

placing the assembled divider elements into a back container;

inserting chattels into cavities formed by the assembled divider elements; and assembling a lid container onto the back container, the assembling of the divider elements further comprises securing at least a portion of the divider elements to a support structure.

11. The method of claim 10, wherein the securing of the at least the portion of the divider elements to the support structure comprises using twist ties.

12. The method of claim 10, further comprising decorating the piñata apparatus, the decorating comprising using tissue and/or crepe paper and securing the tissue and/or crepe paper to the outside of the piñata apparatus.

13. The method of claim 12, wherein the decorating comprises inserting a cardboard cutout into an aperture located on one or both of the lid container and/or the back container.

14. The method of claim 10, further comprising attaching a plurality of aperture covering elements over respective apertures located on the lid container.

15. The method of claim 10, further comprising attaching a thin covering to an inside surface of the lid container.

16. The method of claim 10, wherein the lid container and the back container are stored in the packaging associated with the piñata apparatus in a two-dimensional form and the method further comprises assembling the lid container and the back container into a three-dimensional form.

17. The method of claim 16, wherein the divider elements are stored in the packaging associated with the piñata apparatus in a two-dimensional form and the assembling of the divider elements comprises assembling the divider elements into a three-dimensional form.

* * * * *